US007950789B2

(12) United States Patent
Matsumoto et al.

(10) Patent No.: US 7,950,789 B2
(45) Date of Patent: May 31, 2011

(54) LIQUID CONTAINER

(75) Inventors: Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 966 days.

(21) Appl. No.: 11/835,408

(22) Filed: Aug. 7, 2007

(65) Prior Publication Data

US 2008/0252701 A1 Oct. 16, 2008

(30) Foreign Application Priority Data

Aug. 8, 2006 (JP) ..... 2006-215222

(51) Int. Cl.
*B41J 2/175* (2006.01)

(52) U.S. Cl. ..... 347/86; 347/49

(58) Field of Classification Search ..... 347/19, 347/49, 50, 86

See application file for complete search history.

(56) References Cited

U.S. PATENT DOCUMENTS

| | | | | |
|---|---|---|---|---|
| 5,138,344 | A * | 8/1992 | Ujita | 347/86 |
| 5,992,975 | A * | 11/1999 | Gasvoda et al. | 347/50 |
| 6,155,678 | A * | 12/2000 | Komplin et al. | 347/86 |
| 6,508,547 | B2 * | 1/2003 | King et al. | 347/86 |
| 6,832,830 | B2 | 12/2004 | Seino | |
| 6,834,945 | B2 * | 12/2004 | Ishizawa et al. | 347/86 |
| 7,226,154 | B2 | 6/2007 | Seino et al. | |
| 2003/0222940 | A1 | 12/2003 | Seino et al. | |
| 2005/0001888 | A1 | 1/2005 | Seino | |
| 2007/0206076 | A1 | 9/2007 | Seino et al. | |

FOREIGN PATENT DOCUMENTS

| | | | |
|---|---|---|---|
| EP | 1 247 651 | A2 | 10/2002 |
| JP | 200334110 | A1 | 12/2003 |
| JP | 2006-116793 | A | 5/2006 |

* cited by examiner

*Primary Examiner* — Ant T. N. Vo
(74) *Attorney, Agent, or Firm* — Sughrue Mion, PLLC

(57) ABSTRACT

The invention provides a liquid container for supplying liquid to a liquid consumption apparatus, and includes: a container body that is detachably attached to a container attachment unit of the liquid consumption apparatus; first and second positioning portions that prevent the movement of the container body when corresponding first and second positioning members provided on the container attachment unit fit therein, respectively; a liquid feed outlet to communicate with a liquid supply unit on the container attachment unit to supply liquid from the liquid container to the liquid consumption apparatus; an information memory unit; electric contacts that cause the information memory unit provided on the container body to be connected to an information control circuit of the liquid consumption apparatus; and an engaging portion preventing the detachment of the container body from the container attachment unit when an engaging member engages therewith.

7 Claims, 6 Drawing Sheets

LIQUID CONTAINER

CROSS-REFERENCE TO RELATED APPLICATIONS

This application is based on Japanese Patent Application No. 2006-215222, filed Aug. 8, 2006, the entire disclosure of which is expressly incorporated by reference herein.

BACKGROUND OF THE INVENTION

1. Technical Field

The present invention relates to a liquid container, and more particularly to a liquid container that has, on an outer wall surface of the container body thereof, electric contacts of an information memory unit that are to be connected to a contact terminal provided on a liquid consumption apparatus.

2. Related Art

A known example of various kinds of liquid consumption apparatuses is an ink-jet recording apparatus. In a typical operation thereof, an ink-jet recording apparatus feeds ink (liquid) retained in an ink cartridge (liquid container) that is detachably attached to a cartridge attachment unit (container attachment unit) provided in the apparatus into a recording head. Then, the ink-fed recording head ejects and applies ink drops onto a recording target object such as a printing paper so as to record images, characters, or the like thereon.

A recording head of an ink-jet recording apparatus makes use of heat and/or vibration to control the ejection of ink drops. If a user attempts to execute "empty-cartridge printing" after ink retained in an ink cartridge has run out, the ink-jet recording apparatus could have a breakdown. The term "empty-cartridge printing" means, herein, an attempt to execute ink discharge operation when there is no supply of ink. In order to prevent the recording head from performing empty-cartridge printing, in a typical ink-jet recording apparatus, it is necessary to monitor the remaining amount of ink contained in the ink cartridge.

Depending on the service and working condition of an ink-jet recording apparatus, the color(s) and amount of ink consumed most heavily (in a greater amount than others) may vary from one implementation to another. For example, the colors and amount of ink consumed heavily under one service condition in which the ink-jet recording apparatus is mainly used for full-color photo printing are not the same as those consumed heavily under another service condition in which the ink-jet recording apparatus is mainly used for black-and-white text printing. In consideration of the above fact, some of the latest ink-jet recording apparatuses are configured in such a manner that the apparatus allows a part of a plurality of ink cartridges attached thereto to be replaced by another one suited for its actual service condition. In such a type of ink-jet recording apparatus, it is necessary to keep a log of "use" history, or the like, of each ink cartridge so as to identify, for example, whether an ink cartridge that gets attached to a cartridge attachment unit thereof is a new one, or a re-attached one that has been used before.

On the basis of the above-described technical needs and backgrounds, a certain type of ink cartridge has been proposed in order to provide a solution therefor. The proposed ink cartridge is provided with, firstly, information memory means (a memory chip) for storing various items of information including but not limited to the remaining amount of ink, use history, and the like, where the information memory means is provided on the container body thereof in which ink is retained, and is further provided with, secondly, on the outer wall surface of the container body thereof, electric contacts that are arranged so as to contact with a connection terminal provided at the cartridge-attachment-unit side of an ink-jet recording apparatus so as to electrically connect the information memory means to a circuit provided in the ink-jet recording apparatus.

With such an ink cartridge attached thereto, the ink-jet recording apparatus is capable of keeping an accurate log of the remaining amount of ink, which is achieved by, for example, updating the remaining amount of ink stored in the information memory means provided at the ink-cartridge side of the above-described system configuration on the basis of the amount of ink consumed during print processing or another quantitative factor. By this means, it is possible to effectively prevent the recording head from performing empty-cartridge printing. In addition, the ink-jet recording apparatus updates the use history that is memorized in the information memory means, which could be utilized, for example, to prevent any erroneous attachment of an ink cartridge.

To effectively utilize information memory means provided on an ink cartridge, however, a special technique is required in order to improve the positioning precision of the electric connection portion in the mechanical/physical contact structure constituted by the ink cartridge and the cartridge attachment unit so as to avoid any defective contact therebetween. That is, positioning precision is required to avoid any imperfect electric contact (i.e., poor electric connection state) between the electric contacts (i.e., contact points) of the information memory means provided on the ink cartridge and the connection terminal provided on the cartridge attachment unit. Imperfect electric connection could occur due to, for example, positional error and/or positional tolerance between the ink cartridge and the cartridge attachment unit. An example of a special technique for improving positioning precision is disclosed in JP-A-2003-341100.

FIG. 3 illustrates, as an example of related art, an ink cartridge 101 that is provided with the information memory means described above, and a cartridge attachment unit 111 of an ink-jet recording apparatus. The ink cartridge 101 is detachably attached to the cartridge attachment unit 111. As illustrated in FIG. 4B, the ink cartridge 101 has the shape of a low-profile rectangular parallelepiped that has a container body 102, which has an ink retainer portion inside thereof. A first positioning means 103*a*, a second positioning means 103*b*, and an ink feed port 104 are provided on the front surface 102*a* of the container body 102, which constitutes a first outer wall surface of the container body 102 of the ink cartridge 101.

The first positioning means 103*a* and the second positioning means 103*b* are positioning holes that are aligned in the longitudinal direction of the front surface 102*a* with a certain distance/space provided therebetween. The first positioning means 103*a* and the second positioning means 103*b* are configured as a pair of female joint structures into which a pair of male joint structures, specifically, a first positioning member 113*a* and a second positioning member 113*b* fit respectively. The first positioning member 113*a* and the second positioning member 113*b* (i.e., male) are provided on a first opposing surface 112, which is opposed to the front surface 102*a* of the container body 102 when the ink cartridge 101 is attached to the cartridge attachment unit 111, of the cartridge attachment unit 111 as illustrated in FIG. 4A. This joint structure prevents undesirable movement of the container body 102 in a direction along the front surface 102*a*.

The ink feed port 104 is provided between the first positioning means 103*a* and the second positioning means 103*b*. An ink supply needle 114 illustrated in FIG. 4A, which is provided on the first opposing surface 112 of the cartridge attachment unit 111, communicates with the ink retainer portion inside via the ink feed port 104. In other words, it is inserted through the ink feed port 104 so as to reach the ink retainer portion inside.

As illustrated in FIG. 4B, the right surface 102*b* of the container body 102 of the ink cartridge 101, which constitutes a second outer wall surface thereof that is orthogonal to the front surface 102*a* thereof, has an auxiliary side surface 102*c*. The auxiliary side surface 102*c* is formed as a depression that is a step lower than the level of the right surface 102*b* and is in parallel with the right surface 102*b*. A memory substrate 105*b* having a plurality of electric contacts 105*a* on the top surface thereof is mounted on the auxiliary side surface 102*c*.

The memory substrate 105*b* has a memory chip for storing information that is mounted on its rear surface. The electric contacts 105*a* provided on the top surface of the memory substrate 105*b* "press-contact" (i.e., get into a contact state under a pressing force) a connection/contact terminal 116 that is, as illustrated in FIG. 4A, provided on a second opposing surface 115 of the cartridge attachment unit 111, which is opposed to the right surface 102*b* of the container body 102 of the ink cartridge 101 when the ink cartridge 101 is attached to the cartridge attachment unit 111. By this means, the memory chip provided on the memory substrate 105*b* becomes electrically connected to a control circuit provided in the ink-jet recording apparatus. Through the connection established between the memory chip of the ink cartridge 101 and the control circuit provided in the ink-jet recording apparatus, it becomes possible to read/write information from/into the memory chip in response to an operation instruction given from the control circuit.

For the purpose of preventing any inadvertent detachment of the ink cartridge 101 from the cartridge attachment unit 111, as illustrated in FIG. 4B, the ink cartridge 101 has a projection 107 on the top surface 102*d*, which constitutes a third outer wall surface orthogonal to the front surface 102*a* and the right surface 102*b* of the container body 102 thereof.

On the other hand, as illustrated in FIG. 4A, a latch member 119 is provided on a third opposing surface 118 of the cartridge attachment unit 111 that gets opposed to the top surface 102*d* of the container body 102 when the ink cartridge 101 gets attached to the cartridge attachment unit 111. As illustrated in FIG. 3, the latch member 119 hooks on the rear end of the projection 107 provided on the container body 102 of the ink cartridge 101, as the ink cartridge 101 is inserted in the cartridge attachment unit 111, so as to prevent the ink cartridge 101 from being detached from the cartridge attachment unit 111.

The related-art ink cartridge 101 having a configuration described above is carefully designed so that the electric contacts 105*a* are provided in the close proximity of the first positioning means 103*a* provided on the front surface 102*a* of the container body 102. With such a configuration, positioning precision of the electric contacts 105*a* with respect to the connection terminal 116 is heightened to some degree, which reduces the occurrence of imperfect electric connection between the connection terminal 116 and electric contacts 105*a*.

Disadvantageously, however, in the configuration of the related-art ink cartridge 101 described above, the auxiliary side surface 102*c* on which the electric contacts 105*a* are provided does not constitute the same surface as the top surface 102*d* on which the projection is provided. That is, the auxiliary side surface 102*c* is orthogonal to the top surface 102*d*. Therefore, as illustrated in FIG. 3, the position of the projection 107 is "offset" by a distance L in a planar direction of the memory substrate 105*b*. As a result of such an offset, assuming that the pressing/hooking force of the latch member 119 applied to the projection 107 is denoted as F, a moment M, which is mathematically expressed as F times L, is generated. The moment M is a force that rotationally displaces the container body 102 attached to the cartridge attachment unit 111 along the planar direction of the memory substrate 105*b* around the male-female joint position defined by the first positioning member 113*a* and the first positioning means 103*a*. Since the moment M(=F×L) works as a force that causes the position of the electric contacts 105*a*, which are supposed to contact the connection terminal 116, to be shifted in the planar direction of the memory substrate 105*b*, the contact area and/or the contact pressure between the electric contacts 105*a* and the connection terminal 116 become unreliable, which could result in a poor mechanical/physical contact, meaning a bad electric connection therebetween.

In order to address, for example, the above-identified problems without any limitation thereto, as an advantage of some aspects of the invention, the invention provides a liquid container that causes the electric contacts of an information memory unit that is provided on the liquid container to mechanically contact the connection/contact terminal of a container attachment unit/mechanism with a stable contact pressure in a reliable manner when the liquid container is attached to the container attachment unit.

SUMMARY OF THE INVENTION

An advantage of some aspects of the invention is to provide a liquid container that includes: a container body that is detachably attached to a container attachment unit of a liquid consumption apparatus so as to supply liquid retained in an ink retainer portion inside thereof to the liquid consumption apparatus; a first and a second positioning portions that are provided on a first outer wall surface of the container body with a certain distance provided therebetween so as to prevent movement of the container body in a direction along the first outer wall surface thereof when a first and a second positioning members fit therein, respectively, the first and the second positioning members being provided on a first opposing surface of the container attachment unit to which the first outer wall surface thereof is opposed in an attached state; a liquid feed outlet that is provided on the first outer wall surface of the container body in such a manner that a liquid supply unit, which is provided on the first opposing surface, is communicated with the ink retainer portion inside therethrough; an information memory unit; electric contacts that are provided in a proximity of the first positioning portion on a second outer wall surface of the container body which is orthogonal to the first outer wall surface thereof, the electric contacts causing the information memory unit provided on the container body to be connected to an information control circuit of the liquid consumption apparatus when the electric contacts are press-contacted with a connection terminal, which is provided on a second opposing surface of the container attachment unit that is opposed to the second outer wall surface in an attached state; and an engaging portion that is provided at the second-outer-wall-surface side when viewed from a central axis of the first positioning portion, the engaging portion preventing the detachment of the container body from the container attachment unit when an engaging member provided on the second opposing surface engages therewith.

With the above-described configuration of a liquid container according to some aspects of the invention, since the electric contacts of an information memory unit which is mounted on a liquid container are provided on the second outer wall surface of the container body which is perpendicularly adjacent to (i.e., orthogonal to) the first outer wall surface thereof in the close proximity of the first positioning portion, it is possible to fix/determine the position of the electric contacts with high positioning precision in accordance with the positioning precision of the first positioning portion.

In addition, the engaging portion, which the engaging member of the container attachment unit engages with (for example, hooks on, fits into, without any limitation thereto) so as to prevent any inadvertent detachment of the container body from the container attachment unit, is also provided on the second outer wall surface of the container body in addition to the electric contacts. Therefore, for example, if the engaging portion and the electric contacts are aligned on the same longitudinal section of the second outer wall surface (at the second-outer-wall-surface side), it is possible to eliminate the offset amount in a planar direction of the electric contacts between the engaging portion and the electric contacts completely (i.e., to zero).

With such a configuration, a force (such as a pressing/hooking force) applied from the engaging member of the container attachment unit to the engaging portion does not generate any moment that works to rotationally displace the container body along the planar direction of the electric contacts around the joint position defined by the first positioning member and the first positioning portion. Therefore, the invention ensures that the electric contacts of the information memory unit that is provided on the container body of the liquid container mechanically contact the connection terminal of the container attachment unit with a stable contact pressure in a reliable manner when the liquid container is attached to the container attachment unit.

In the liquid container having the above-described configuration, it is preferable that the first and the second positioning members are positioning pins that protrude toward the container body, and the first positioning portion is formed as a round hole into which the first positioning member is jointed, whereas the second positioning portion is formed as an elliptical hole into which the second positioning member is jointed.

The above-described preferable configuration of a liquid container according to some aspect of the invention makes it easier for a user to attach the liquid container to the container attachment unit because, at the second positioning portion where an elliptical hole is adopted, there is some allowance that eases the joint (for example, male-female joint) between the second positioning member of the container attachment unit and the elliptical second positioning portion. On the other hand, at the first positioning portion where a round hole is adopted, a relatively high positioning precision is ensured because there is relatively small allowance for inserting the first positioning member of the container attachment unit into the round first positioning portion. This makes it further possible to improve the positioning precision of the electric contacts, which are provided in the vicinity of the first positioning portion.

In the liquid container having the above-described configuration, it is preferable that the second outer wall surface is perpendicularly adjacent to the first outer wall surface, with the first-positioning-portion-side edge of the first outer wall surface being the boundary therebetween (for example, the second outer wall surface constitutes an outer wall surface that is orthogonal to the first outer wall surface, intersecting at an edge closer to the first positioning portion). With the above-described configuration of a liquid container according to some aspects of the invention, the second outer wall surface, on which the electric contacts of an information memory unit as well as the engaging portion for preventing any inadvertent detachment of the container body from the container attachment unit are provided, constitutes an outer wall surface having a relatively narrow width among four outer wall surfaces of the container body that are perpendicularly adjacent to the first outer wall surface thereof. Therefore, the invention realizes, advantageously, a space-saving arrangement of a plurality of liquid containers when they are aligned adjacent to one another for attachment, which is achieved because the second outer wall surface of each of them does not face to any other adjoining liquid containers.

In the liquid container having the above-described configuration, it is preferable that the first and second positioning portions provided on the first outer wall surface of the container body, the electric contacts provided on the second outer wall surface thereof, and the engaging portion provided on the second outer wall surface thereof are aligned on the same longitudinal section of the container body. With the above-described configuration of a liquid container according to some aspects of the invention, a force (such as a pressing/hooking force) applied from the engaging member of the container attachment unit to the engaging portion works on the longitudinal/vertical section that passes through the first positioning portion, the second positioning portion, and the electric contacts. For this reason, it is possible to reduce the offset amount in a planar direction of the electric contacts between the engaging portion and the electric contacts to zero. In addition, for the same reason, it is also possible to reduce the offset amount in a planar direction of the electric contacts between the engaging portion and the first and second positioning portions to zero.

Thus, the invention ensures that the rotational displacement of the container body along the planar direction of the electric contacts, which deteriorates the mechanical contact between the electric contacts of the container body and the connection terminal of the container attachment unit, does not occur. This results in an enhanced and reliable electric connection between the electric contacts of the container body and the connection terminal of the container attachment unit.

In the liquid container having the above-described configuration, it is preferable that the electric contacts are provided at positions closer to the first outer wall surface of the container body in comparison with the engaging portion. With the above-described configuration of a liquid container according to some aspects of the invention, a force (such as a pressing/hooking force) applied from the engaging member provided on the container attachment unit to the engaging portion generates a moment that urges the container body in a direction to increase the contact pressure between the electric contacts and the connection terminal around the joint position defined by the first positioning member of the container attachment unit and the first positioning portion of the container body. Thus, it is possible to further improve the reliability of electric connection thanks to the increased mechanical contact pressure between the electric contacts and the connection terminal.

In the liquid container having the above-described configuration, it is preferable that the second outer wall surface does not face to any other adjoining container bodies when a plurality of the liquid containers are aligned adjacent to one another to be attached to the liquid consumption apparatus.

With the above-described configuration of a liquid container according to some aspects of the invention, it is not necessary to allocate any special space/distance, which allows mechanical components such as the connection terminal and the engaging member of an ink-jet recording apparatus, which co-operate with the electric contacts and the engaging portion provided on the container body thereof respectively to be provided between each two adjacent ones of the plurality of liquid containers that are aligned adjacent to one another for attachment to the container attachment unit. Thus, the invention provides, advantageously, a "close-packed" layout of the liquid containers on the container attachment unit, which efficiently reduces a gap between each two adjacent ones of the liquid containers. This further means that the invention realizes a more compact container attachment unit.

Since the electric contacts of an information memory unit which is mounted on a liquid container are provided on the second outer wall surface of the container body which is perpendicularly adjacent to (i.e., orthogonal to) the first outer wall surface thereof in the close proximity of the first positioning portion, a liquid container according to some aspects of the invention makes it possible to fix/determine the position of the electric contacts with high positioning precision in accordance with the positioning precision of the first positioning portion.

In addition, the engaging portion that prevents any inadvertent detachment of the container body (i.e., liquid container) from the container attachment unit is also provided on the second outer wall surface of the container body in addition to the electric contacts. Therefore, for example, if the engaging portion and the electric contacts are aligned on the same longitudinal section of the second outer wall surface (at the second-outer-wall-surface side), it is possible to eliminate the offset amount in a planar direction of the electric contacts between the engaging portion and the electric contacts completely (i.e., to zero).

With such a configuration, a force (such as a pressing/hooking force) applied from the engaging member of the container attachment unit to the engaging portion does not generate any moment that works to rotationally displace the container body along the planar direction of the electric contacts around the joint position defined by the first positioning member and the first positioning portion. Therefore, the invention ensures that the electric contacts of the information memory unit that is provided on the container body of the liquid container mechanically contact the connection terminal of the container attachment unit with a stable contact pressure in a reliable manner when the liquid container is attached to the container attachment unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
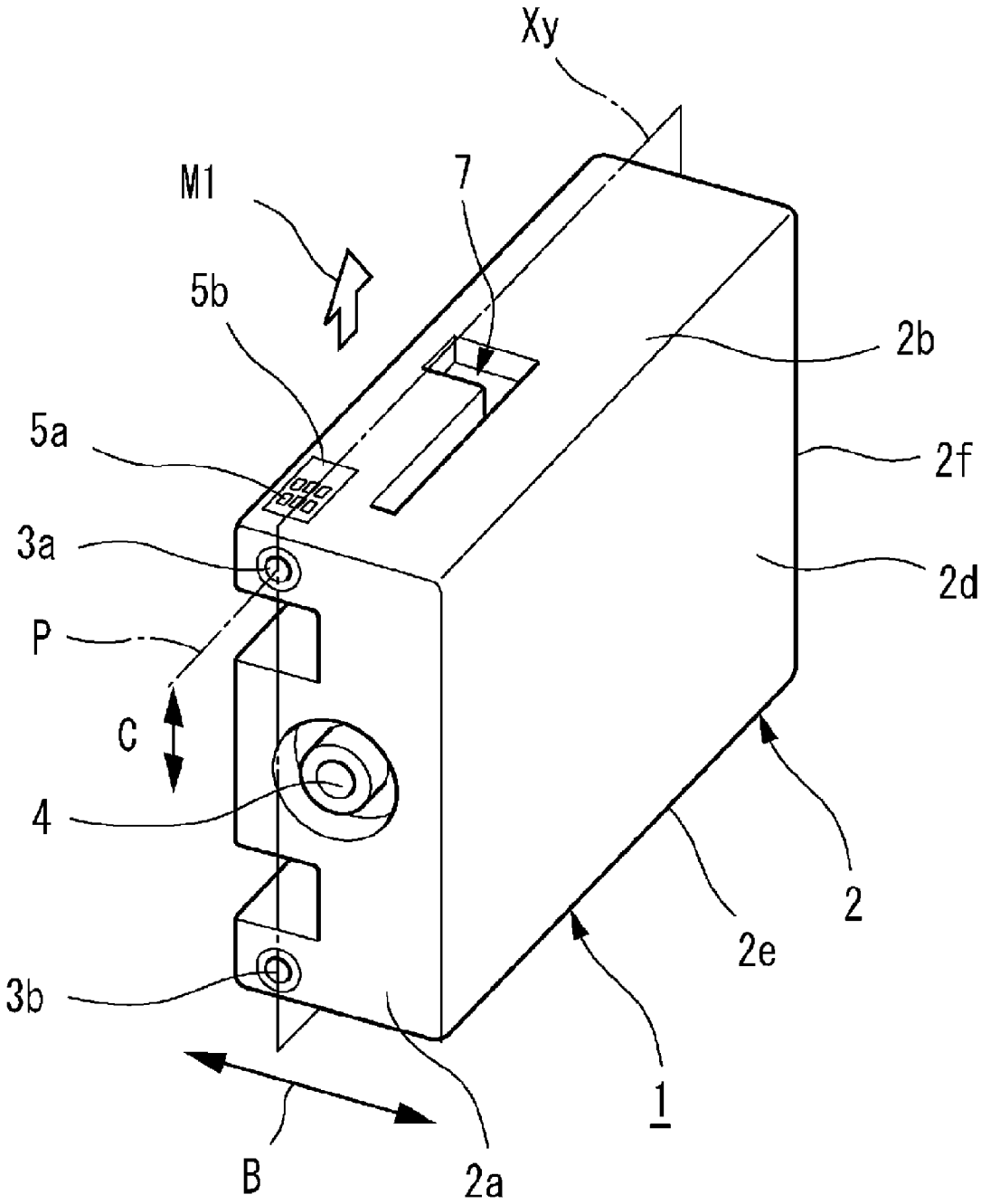
FIG. 1 is a front perspective view of a liquid container according to an exemplary embodiment of the invention that is observed from a certain virtual point above the liquid container in a downward direction at an oblique/perspective angle to show a front face and two other adjoining faces thereof.
Figure 2:
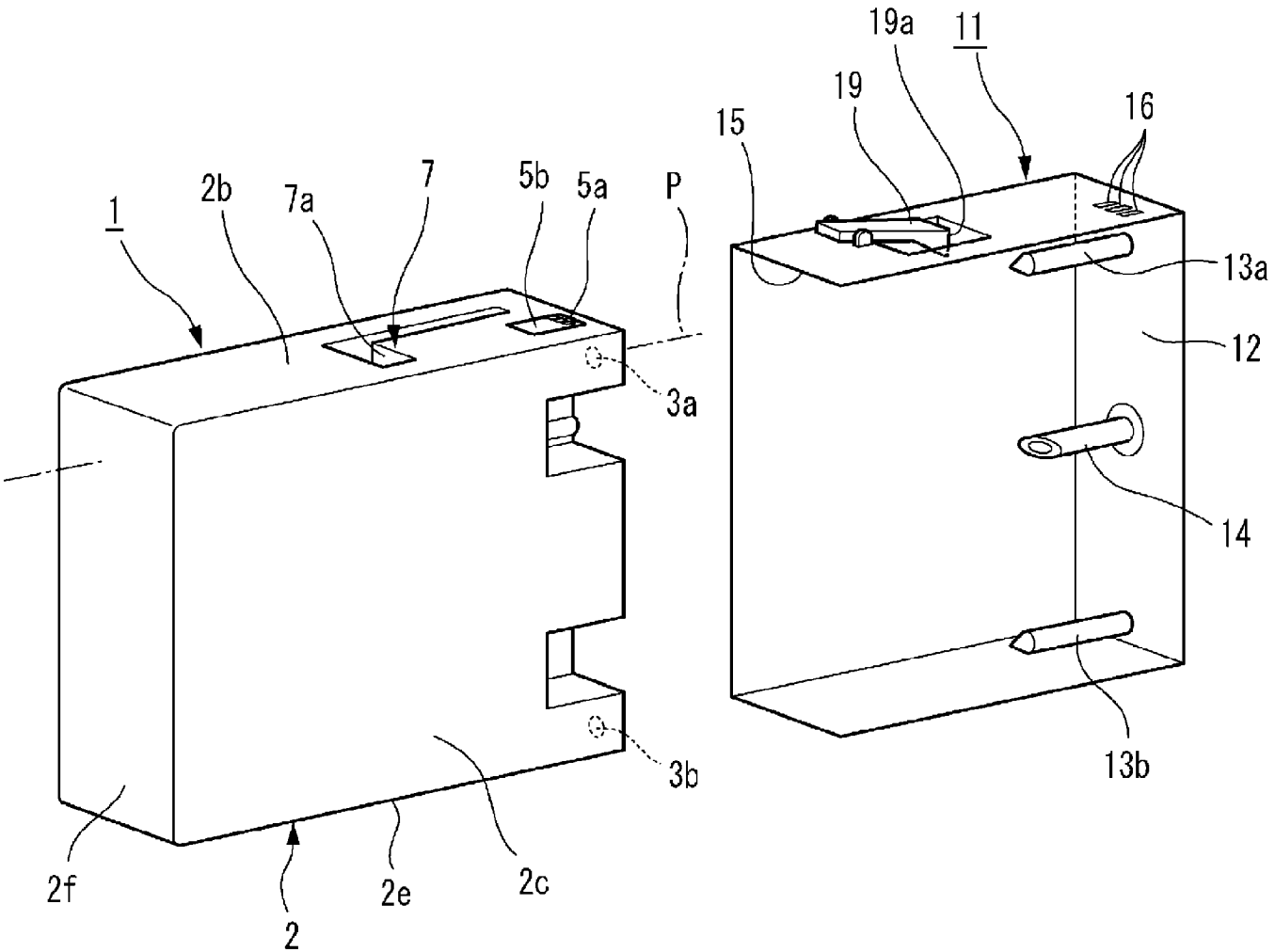
FIG. 2 is a rear perspective view of the liquid container illustrated in FIG. 1 that is observed from another virtual point above the liquid container in a downward direction at an oblique angle to show the rear face and two other adjoining faces thereof, further illustrating a container attachment unit/portion to which the liquid container is attached.
Figure 3:
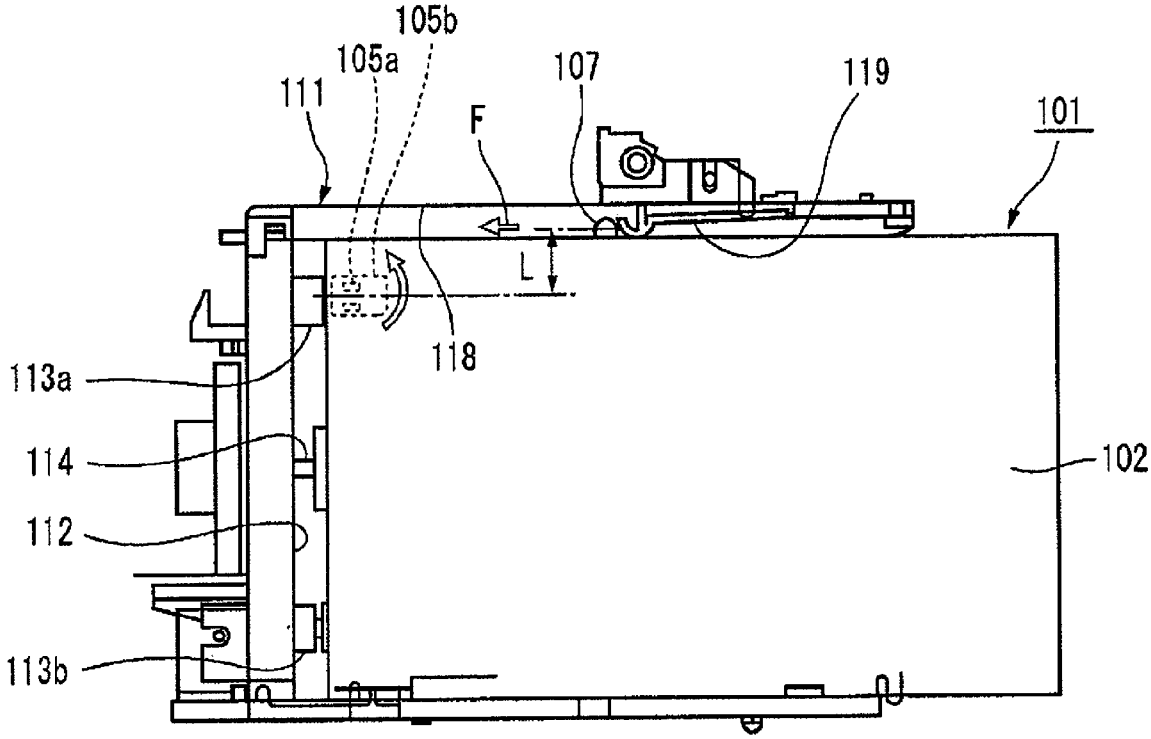
FIG. 3 RELATED ART
FIG. 3 is a side view of a related-art ink cartridge attached to a cartridge attachment unit.
Figure 4B:
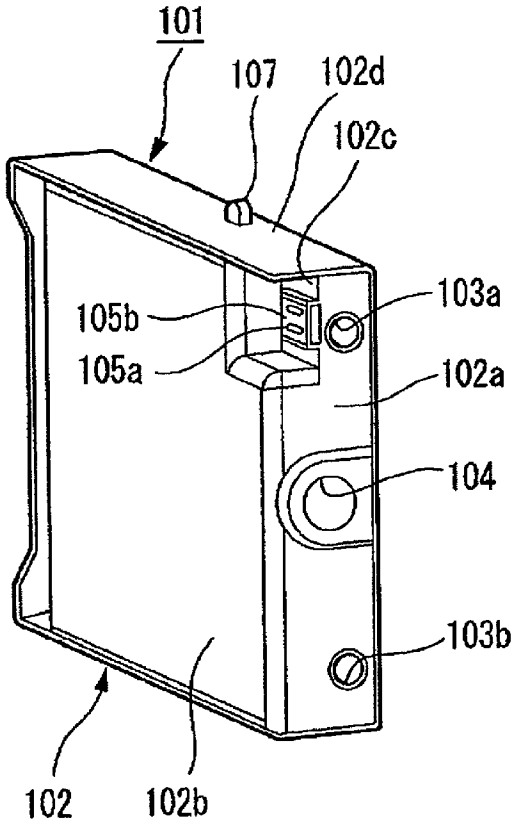
FIG. 4B PRIOR ART
FIG. 4B is a front perspective view of the ink cartridge illustrated in FIG. 3 that is observed from a certain virtual point above the ink cartridge in a downward direction at an oblique angle to show the front face and two other adjoining faces thereof.
Figure 4A:
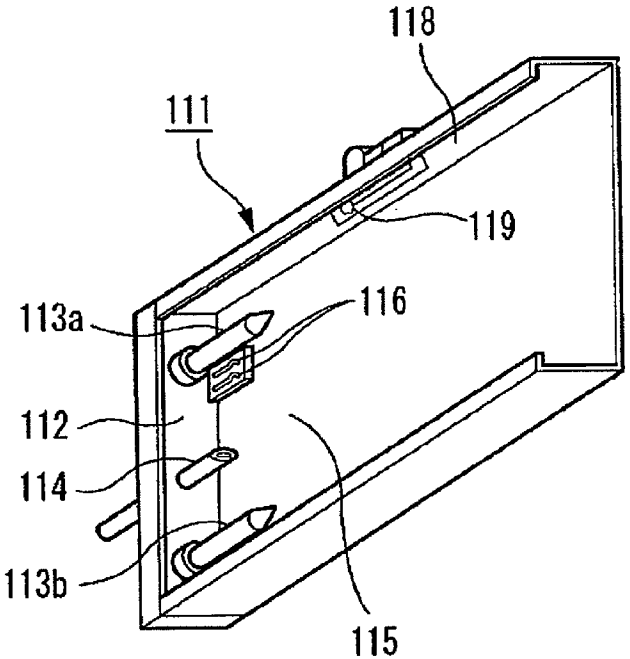
FIG. 4A PRIOR ART
FIG. 4A is a perspective view of the cartridge attachment unit illustrated in FIG. 3, which is observed from the cartridge-insertion side thereof at an oblique angle.

With reference to the accompanying drawings, a liquid container according to an exemplary embodiment of the invention is described in detail below. FIG. 1 is a front perspective view of a liquid container according to an exemplary embodiment of the invention that is observed from a certain virtual point above the liquid container in a downward direction at an oblique (i.e., perspective) angle to show the front face and two other adjoining faces thereof. FIG. 2 is a rear perspective view of the liquid container illustrated in FIG. 1 that is observed from another virtual point above the liquid container in a downward direction at an oblique/perspective angle to show the rear face and two other adjoining faces thereof. In addition to the rear perspective view of the liquid container, FIG. 2 further illustrates a container attachment unit/portion to which the liquid container is attached.

An ink cartridge 1 according to the present embodiment of the invention is a liquid container that is detachably attached to a cartridge attachment unit (container attachment unit) 11 of an ink-jet recording apparatus, which is an example of various kinds of liquid consumption apparatuses. The ink cartridge 1 is used to feed/supply ink (liquid) to a recording head provided in the ink-jet recording apparatus. As illustrated in FIG. 1 and FIG. 2, the ink cartridge 1 according to the present embodiment of the invention has the shape of a rectangular parallelepiped that is low in profile in the horizontal/width direction (i.e., low-profile when viewed in the direction shown by arrow B in FIG. 1). The ink cartridge 1 has a first positioning hole (a first positioning portion) 3*a*, a second positioning hole (a second positioning portion) 3*b*, and an ink feed port (liquid feed outlet) 4 on the front surface (a first outer wall surface) 2*a* of the container body 2, which has an ink retainer portion inside thereof.

The first positioning hole 3*a* and the second positioning hole 3*b* constitute two positioning portions/means that are aligned in the longitudinal direction of the front surface 2*a* (i.e., vertical/height direction shown by arrow C in FIG. 1) with a certain distance/space provided therebetween. The first positioning hole 3*a* and the second positioning hole 3*b* are configured as a pair of female joint structure which a pair of male joint structure, specifically, a first positioning pin (a first positioning member) 13*a* and a second positioning pin (a second positioning member) 13*b* fit into, respectively. The first positioning pin 13*a* and the second positioning pin 13*b* are provided on a first opposing surface 12, which is opposed to the front surface 2*a* of the container body 2 when the ink cartridge 1 is attached to the cartridge attachment unit 11, of the cartridge attachment unit 11 as illustrated in FIG. 2. This joint structure prevents undesirable move of the container body 2 in a direction along the front surface 2*a*. Each of the first positioning pin 13*a* and the second positioning pin 13*b* of the cartridge attachment unit 11 is configured as a pin for positional determination having a columnar shape with a pointed tip.

The first positioning hole 3*a* is formed as a foramen rotundum (i.e., a round hole) which the first positioning pin 13*a* fits into, whereas the second positioning hole 3*b* is formed as an elliptical hole which the second positioning pin 13*b* fits into.

The ink feed port 4 is provided between the first positioning hole 3*a* and the second positioning hole 3*b*. An ink supply needle (liquid supply unit) 14 illustrated in FIG. 2, which is provided on the first opposing surface 12 of the cartridge attachment unit 11, is communicated with the ink retainer portion inside via the ink feed port 4. In other words, it is inserted through the ink feed port 4 to reach the ink retainer portion inside.

A memory substrate 5*b* having a plurality of electric contacts 5*a* on the top surface (i.e., exposed surface) thereof is mounted on a top surface (i.e., top wall surface) 2*b* of the container body 2, which constitutes a second outer wall surface that is perpendicularly adjacent to the front surface 2*a* with the first-positioning-hole-side (3*a*) edge of the front surface 2*a* being the boundary therebetween. In addition, for the purpose of preventing any inadvertent detachment of the ink cartridge 1 from the cartridge attachment unit 11, an engaging dent portion, or engaging portion 7, is further provided on the top surface 2*b* of the container body 2.

The memory substrate 5*b* has a memory chip (information memory unit/device) for storing information that is mounted on its rear surface. The electric contacts 5*a* provided on the top surface of the memory substrate 5*b* "press-contact" (i.e., get into a contact state under a pressing force) a connection/contact terminal 16 that is provided on a second opposing surface 15 of the cartridge attachment unit 11, which gets opposed to the top surface 2*b* of the container body 2 of the ink cartridge 1 when the ink cartridge 1 gets attached to the cartridge attachment unit 11. By this means, the memory chip provided on the memory substrate 5*b* becomes electrically connected to a control circuit provided in the ink-jet recording apparatus. Through the electric connection established between the memory chip of the ink cartridge 1 and the control circuit provided in the ink-jet recording apparatus, it becomes possible to read/write information from/into the memory chip in response to an operation instruction given from the control circuit. In the present embodiment of the invention, the memory substrate 5*b* is provided on the top surface 2*b* at such a position that the distance between the memory substrate 5*b* and (the first-positioning-hole-side edge of) the front surface 2*a* is shorter than the distance between the engaging dent portion 7 and (the first-positioning-hole-side edge of) the front surface 2*a*. This means that a group of the electric contacts 5*a* is provided at such a position that the distance between the electric contacts 5*a* and the first positioning hole 3*a* is shorter than the distance between the engaging dent portion 7 and the first positioning hole 3*a*.

The engaging dent portion 7 is configured as a cavity formed in the top surface 2*b*, which has a dent structure 7*a* as a rearward-widened portion thereof. The tip 19*a* of a latch member 19, which is provided on the second opposing surface 15 of the cartridge attachment unit 11 in such a manner that it can rotationally move for engagement, is configured to fit into the dent structure 7*a*. By this means, any inadvertent detachment of the ink cartridge 1 from the cartridge attachment unit 11 is avoided. In the present embodiment of the invention, as illustrated in FIG. 1, the first positioning hole 3*a* and the second positioning hole 3*b* provided on the front surface 2*a* of the container body 2 as well as the electric contacts 5*a* and the engaging dent portion 7 provided on the top surface 2*b* thereof are aligned on the same longitudinal section (i.e., vertical section) xy of the container body 2.

Figure 6:
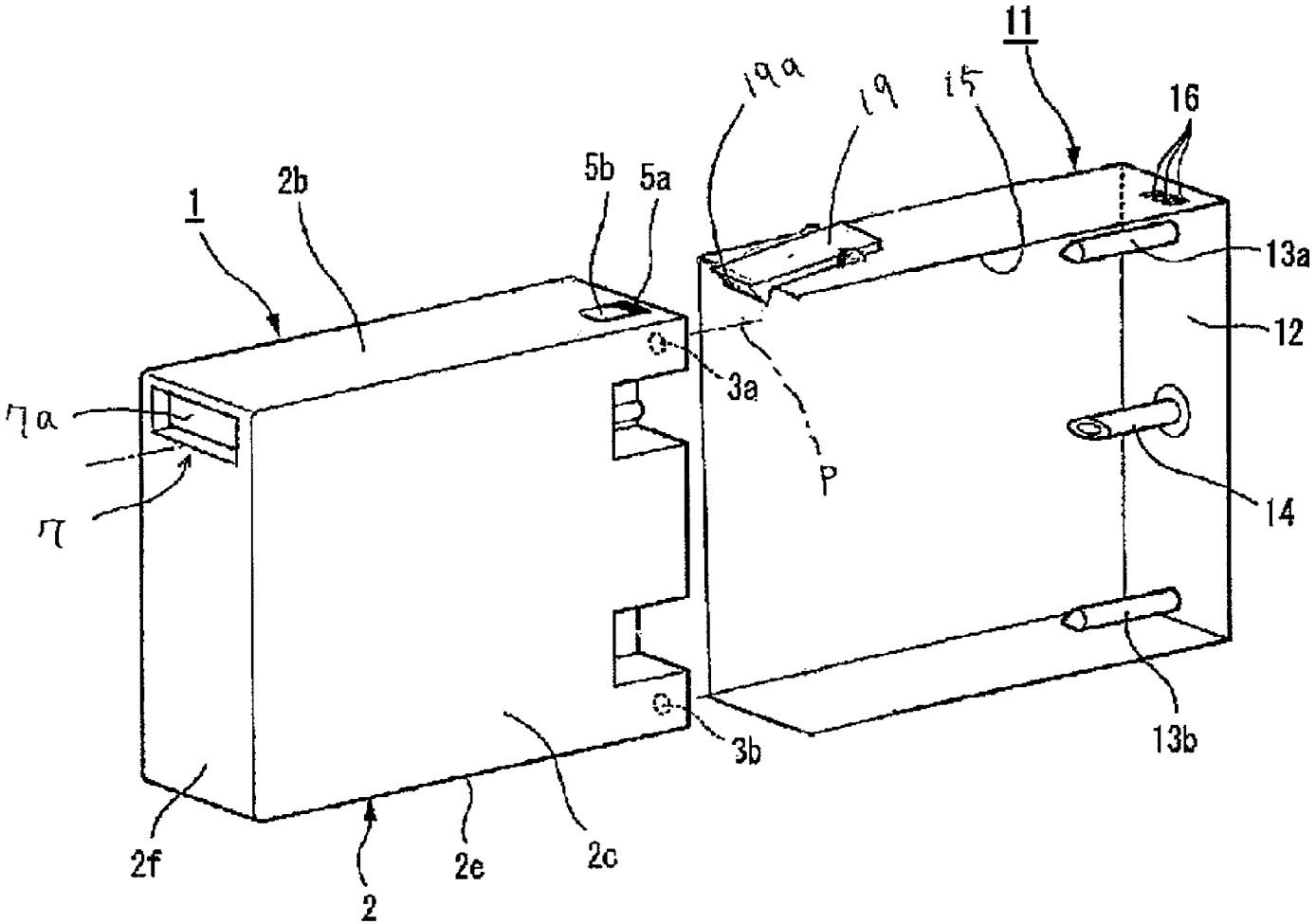
FIG. 6 is a rear perspective view of a liquid container according to an exemplary embodiment.

It should be noted that the position at which the engaging dent portion 7 according to the invention is provided is not limited to the top surface 2*b* of the container body 2. The engaging dent portion 7 may be provided at any other position as long as it is provided at the top-surface (2*b*) side, that is, the-second-outer-wall-surface side thereof when viewed from any position on the central axis P of the first positioning hole 3*a*. For example, the dent structure 7*a* may be provided not on the top surface 2*b* but alternatively on the rear surface 2*f* of the container body 2 as long as it is provided at the top-surface side thereof (i.e., one side closer to the top surface 2*b* than the other) when viewed from any position on the central axis P (as shown in FIG. 6).

Figure 5:
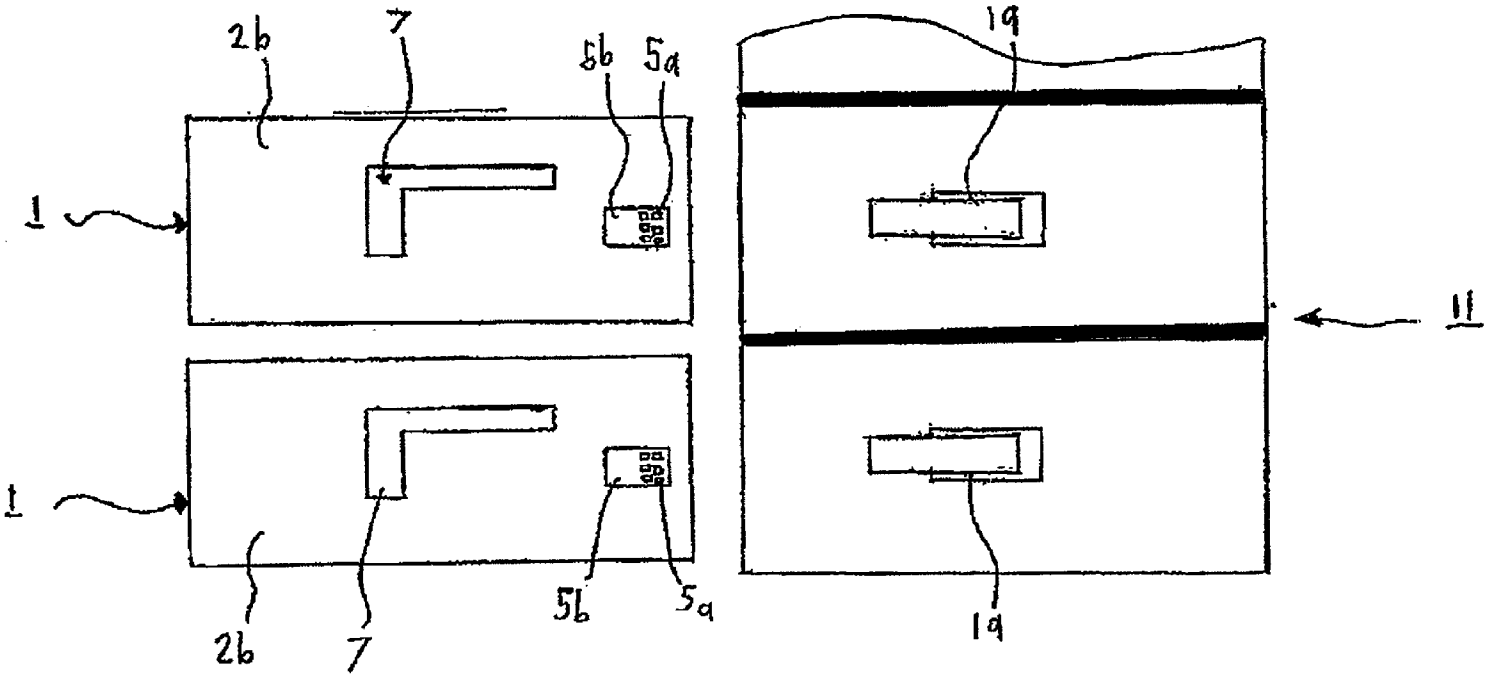
FIG. 5 is a top view of a liquid container according to an exemplary embodiment.

The top surface 2*b* of the container body 2 of each ink cartridge 1 constitutes an outer wall surface thereof that is not opposed to any part/component/surface of the container body 2 of other adjacent ink cartridge(s) when a plurality of ink cartridges 1 are attached to an ink-jet recording apparatus in such a manner that these ink cartridges 1 are aligned adjacent to one another thereon (as shown in FIG. 5).

In other words, when a plurality of ink cartridges 1 according to the present embodiment of the invention are aligned adjacent to one another on an ink jet recording apparatus in the attached state, each of the left surface 2*c* of the container body 2 and the right surface 2*d* thereof (refer to FIG. 1 and FIG. 2) of one ink cartridge 1 constitutes a surface to be opposed to the counterpart of other ink cartridge 1.

With the configuration of the ink cartridge 1 according to the present embodiment of the invention described above, since the electric contacts 5*a* of a memory chip which is mounted on an ink cartridge 1 are provided on the top surface 2*b* of the container body 2 which is perpendicularly adjacent to (i.e., orthogonal to) the front surface 2*a* thereof in the close proximity of the first positioning hole 3*a*, it is possible to fix/determine the position of the electric contacts 5*a* with high positioning precision in accordance with the positioning precision of the first positioning hole 3*a*.

The engaging dent portion 7, which the latch member 19 of the cartridge attachment unit 11 hooks on so as to prevent any inadvertent detachment of the ink cartridge 1 from the cartridge attachment unit 11, is also provided on the top surface 2*b* of the container body 2 in addition to the electric contacts 5*a*. Therefore, if the engaging dent portion 7 and the electric contacts 5*a* are aligned on the same longitudinal section xy of the top surface 2*b* as described in this embodiment of the invention, it is possible to eliminate the offset amount in a planar direction of the electric contacts 5*a* between the engaging dent portion 7 and the electric contacts 5*a* completely (i.e., to zero).

With such a configuration, a pressing/hooking force applied from the latch member 19 of the cartridge attachment unit 11 to the engaging dent portion 7 does not generate any moment that works to rotationally displace the container body 2 along the planar direction of the electric contacts 5*a* around the male-female joint position defined by the first positioning pin 13*a* and the first positioning hole 3*a*. Therefore, the invention ensures that the electric contacts 5*a* of a memory chip that is provided on the ink cartridge 1 mechanically contact the connection/contact terminal 16 of the container attachment unit 11 with a stable contact pressure in a reliable manner when the ink cartridge 1 is attached to the cartridge attachment unit 11.

In addition, according to the above-described configuration, the electric contacts 5*a* of a memory chip mounted on the container body 2 are provided on the top surface 2*b* thereof, which is an outer wall surface on which the engaging dent portion 7 is also provided so as to prevent the ink cartridge 1 from being detached from the cartridge attachment unit 11. That is, the electric contacts 5*a* and the engaging dent portion 7 are provided on the same outer wall surface, that is, the top surface 2*b*. Accordingly, three out of four outer wall surfaces of the container body 2 that are perpendicularly adjacent to the front surface 2*a* thereof, more specifically, the left surface 2*c*, the right surface 2*d*, and the bottom surface 2*e* thereof constitute "plain" outer wall surfaces, meaning that no parts to be connected to the components of the cartridge attachment unit 11 are provided thereon, unlike the top surface 2*b*.

Therefore, with the configuration described above, it is not necessary to allocate any special space/distance each between adjacent ink cartridges 1 when a plurality of ink cartridges 1 are aligned adjacent to one another for attachment, which is ensured because the top surface 2*b* does not face to any other adjoining ink cartridges 1. Such a special space/distance must be otherwise allocated so that mechanical components such as the connection/contact terminal 16 and the latch member 19 of an ink-jet recording apparatus, which co-operate with the electric contacts 5*a* and the engaging dent portion 7, respectively, can be provided between each two adjacent ones of the plurality of ink cartridges 1 that are aligned adjacent to one another. Thus, the invention provides, advantageously, a "close-packed" layout of the ink cartridges 1 on the cartridge attachment unit 11, which efficiently reduces a gap between each two adjacent ones of the ink cartridges 1. This further means that the invention realizes a more compact cartridge attachment unit 11.

In the configuration of the ink cartridge 1 according to the present embodiment of the invention, the first positioning pin 13*a* and the second positioning pin 13*b* provided on the cartridge attachment unit 11 are projected toward the container body 2 of the ink cartridge 1. The first positioning hole 3*a* is formed as a foramen rotundum (i.e., a round hole) which the first positioning pin 13*a* fits into, whereas the second positioning hole 3*b* is formed as an elliptical hole which the second positioning pin 13*b* fits into.

Such a configuration makes it easier for a user to attach the ink cartridge 1 to the cartridge attachment unit 11 because, at the second positioning hole 3*b* where an elliptical hole is adopted, there is some allowance that eases the male-female joint between the second positioning pin 13*b* of the cartridge attachment unit 11 and the elliptical second positioning hole 3*b*. On the other hand, at the first positioning hole 3*a* where a round hole is adopted, a relatively high positioning precision is ensured because there is relatively small allowance for inserting the first positioning pin 13*a* of the cartridge attachment unit 11 into the round first positioning hole 3*a*. This makes it further possible to improve the positioning precision of the electric contacts 5*a*, which are provided in the vicinity of the first positioning hole 3*a*.

In the configuration of the ink cartridge 1 according to the present embodiment of the invention, the top surface 2*b*, on which the electric contacts 5*a* of a memory chip as well as the engaging dent portion 7 for preventing any inadvertent detachment of the ink cartridge 1 from the cartridge attachment unit 11 are provided, constitutes an outer wall surface having a relatively narrow width among four outer wall surfaces of the container body 2 that are perpendicularly adjacent to the front surface 2*a* thereof. Therefore, the invention realizes, advantageously, a space-saving arrangement of a plurality of ink cartridges 1 when they are aligned adjacent to one another for attachment, which is achieved because the top surface 2*b* of each of them does not face to any other adjoining ink cartridges 1.

In the ink cartridge 1 according to the present embodiment of the invention, the first positioning hole 3*a* and the second positioning hole 3*b* provided on the front surface 2*a* of the container body 2 as well as the electric contacts 5*a* and the engaging dent portion 7 provided on the top surface 2*b* thereof are aligned on the same longitudinal section xy of the container body 2. Therefore, a pressing/hooking force applied from the latch member 19 of the cartridge attachment unit 11 to the engaging dent portion 7 works on the longitudinal/vertical section that passes through the first positioning hole 3*a*, the second positioning hole 3*b*, and the electric contacts 5*a*. For this reason, it is possible to reduce the offset amount in a planar direction of the electric contacts 5*a* between the engaging dent portion 7 and the electric contacts 5*a* to zero. In addition, for the same reason, it is also possible to reduce the offset amount in a planar direction of the electric contacts 5*a* between the engaging dent portion 7 and the first and second positioning holes 3*a* and 3*b* to zero.

Thus, the invention ensures that the rotational displacement of the container body 2 along the planar direction of the electric contacts 5*a*, which deteriorates the mechanical contact between the electric contacts 5*a* of the container body 2 and the connection/contact terminal 16 of the cartridge attachment unit 11, does not occur. This results in an enhanced and reliable electric connection between the electric contacts 5*a* of the container body 2 and the connection/contact terminal 16 of the cartridge attachment unit 11.

Moreover, in the configuration of the ink cartridge 1 according to the present embodiment of the invention, as illustrated in FIG. 1, the electric contacts 5*a* are provided at positions closer to the front surface 2*a* of the container body 2 in comparison with the engaging dent portion 7. Therefore, a pressing/hooking force applied from the latch member 19 onto the cartridge attachment unit 11 to the engaging dent portion 7 generates a moment that urges the container body 2 in a direction to increase the contact pressure between the electric contacts 5*a* and the connection/contact terminal 16 (i.e., a direction shown by arrow M1 in FIG. 1) around the male-female joint position defined by the first positioning pin 13*a* of the cartridge attachment unit 11 and the first positioning hole 3*a* of the container body 2. Thus, it is possible to further improve the reliability of the electric connection thanks to the increased mechanical contact pressure between the electric contacts 5*a* and the connection/contact terminal 16.

It should be noted that the application and use of a liquid container according to the invention is not limited to an ink cartridge that is described in the above exemplary embodiment as a specific example thereof. In addition, a liquid consumption apparatus that is provided with a container attachment unit to which a liquid container according to the invention is attached is not limited to an ink-jet recording apparatus described in the above exemplary embodiment. In addition to an ink-jet recording apparatus described in the exemplary embodiment above, a liquid consumption apparatus to which the invention is applicable encompasses a wide variety of other types of apparatuses such as one that is provided with a container attachment unit to which a liquid container is detachably attachable so as to supply liquid retained therein to the apparatus. Examples of a liquid consumption apparatus according to the invention include, without any limitation thereto: an apparatus that is provided with a color material ejection head that is used in the production of color filters for a liquid crystal display device or the like; an apparatus that is provided with an electrode material (i.e., conductive paste) ejection head that is used for electrode formation for an organic EL display device, a surface/plane emission display device (FED), and the like; an apparatus that is provided with a living organic material ejection head used for production of biochips; and an apparatus that is provided with a sample ejection head functioning as a high precision pipette.

While this invention has been described in conjunction with the specific embodiments thereof, it is evident that many alternatives, modifications, and variations will become apparent to those familiar with this field upon reading the description above. Accordingly, the preferred embodiments of the invention as set forth herein are intended to be illustrative, not limiting. Such alternatives, modifications, and variations are permissible without departing from the scope and spirit of the invention.

What is claimed is:

1. A liquid container comprising:

a container body that is detachably attachable to a container attachment unit of a liquid consumption apparatus so as to supply a liquid retained in an ink retainer portion inside the container body to the liquid consumption apparatus;

a first and a second positioning portions that are provided on a first outer wall surface of the container body with a certain distance provided therebetween so as to prevent movement of the container body in a direction along the first outer wall surface thereof when a first and a second positioning members fit therein, respectively; the first and the second positioning members being provided on a first opposing surface of the container attachment unit to which the first outer wall surface thereof is opposed in an attached state;

a liquid feed outlet that is provided on the first outer wall surface of the container body in such a manner that a liquid supply unit, which is provided on the first opposing surface, is communicated with the ink retainer portion inside therethrough when the container body is detachably attached to the container attachment unit;

an information memory unit provided on the container body;

electric contacts that are provided on a second outer wall surface of the container body, which is orthogonal to the first outer wall surface thereof and in the proximity of the first positioning portion, the electric contacts causing the information memory unit provided on the container body to be connected to an information control circuit of the liquid consumption apparatus when the electric contacts are press-contacted with a connection terminal, which is provided on a second opposing surface of the container attachment unit that is opposed to the second outer wall surface in an attached state; and an engaging portion that is provided on the second outer wall surface or on a side of a third outer wall surface, said third outer wall surface being parallel to the first outer wall surface and said side being near the second outer wall surface when viewed from a central axis of the first positioning portion, the engaging portion preventing the detachment of the container body from the container attachment unit when an engaging member provided on the second opposing surface engages therewith, wherein the second outer wall surface only faces in substantially one direction.

2. The liquid container according to claim 1, wherein the first and the second positioning members are positioning pins that protrude toward the container body, wherein the first positioning portion is formed as a round hole into which the first positioning member is jointed, and wherein the second positioning portion is formed as an elliptical hole into which the second positioning member is jointed.

3. The liquid container according to claim 1, wherein the second outer wall surface is perpendicularly adjacent to the first outer wall surface, with an edge of the first outer wall surface being the boundary therebetween.

4. The liquid container according to claim 1, wherein the first and second positioning portions provided on the first outer wall surface of the container body, the electric contacts provided on the second outer wall surface thereof, and the engaging portion provided on the second outer wall surface thereof are aligned on the same longitudinal section of the container body.

5. The liquid container according to claim 1, wherein the electric contacts are provided at positions closer to the first outer wall surface of the container body in comparison with the engaging portion.

6. The liquid container according to claim 1, wherein the second outer wall surface does not face any other adjoining container bodies when a plurality of the liquid containers are aligned adjacent to one another to be attached to the liquid consumption apparatus.

7. The liquid container according to claim 1, wherein the first outer wall is a front outer wall when the container body is detachably attached to the container attachment unit, wherein the second outer wall is a top outer wall when the container body is detachably attached to the container attachment unit, and wherein the third outer wall is a rear outer wall when the container body is detachably attached to the container attachment unit.

* * * * *